United States Patent [19]

Bauer et al.

[11] Patent Number: 4,956,970

[45] Date of Patent: Sep. 18, 1990

[54] FALSE TWIST ROLL

[75] Inventors: Karl Bauer; Hellmut Lorenz, both of Remscheid, Fed. Rep. of Germany

[73] Assignee: Barmag AG, Remscheid, Fed. Rep. of Germany

[21] Appl. No.: 360,884

[22] PCT Filed: Oct. 16, 1988

[86] PCT No.: PCT/DE88/00637

§ 371 Date: May 11, 1989

§ 102(e) Date: May 11, 1989

[87] PCT Pub. No.: WO89/03905

PCT Pub. Date: May 5, 1989

[30] Foreign Application Priority Data

Oct. 23, 1987 [DE] Fed. Rep. of Germany ..... 3735942

[51] Int. Cl.[5] ..... D02G 1/08

[52] U.S. Cl. ..... 57/334; 57/331; 57/348

[58] Field of Search ..... 57/332, 334, 335, 331, 57/284, 288, 348

[56] References Cited

U.S. PATENT DOCUMENTS

| | | | |
|---|---|---|---|
| 3,559,391 | 2/1971 | Rice | 57/334 X |
| 3,680,302 | 8/1972 | Hess et al. | 57/334 X |
| 3,735,575 | 5/1973 | Hattori | 57/331 |
| 3,998,041 | 12/1976 | Graf et al. | 57/337 |
| 4,204,394 | 5/1980 | Lüthi | 57/334 |
| 4,237,686 | 12/1980 | Fluck et al. | 57/337 |
| 4,562,694 | 1/1986 | Sumar | 57/331 X |

FOREIGN PATENT DOCUMENTS

| | | | |
|---|---|---|---|
| 6941966 | 3/1970 | Fed. Rep. of Germany . | |
| 1660654 | 4/1972 | Fed. Rep. of Germany . | |
| 2460031 | 7/1975 | Fed. Rep. of Germany | 57/334 |
| 2931718 | 2/1981 | Fed. Rep. of Germany . | |
| 1425246 | 12/1965 | France . | |
| 1185684 | 3/1970 | United Kingdom . | |
| 1231156 | 5/1971 | United Kingdom . | |

*Primary Examiner*—John Petrakes

*Attorney, Agent, or Firm*—Bell, Seltzer, Park & Gibson

[57] ABSTRACT

A false twisting roll for imparting false twist to an advancing yarn of manmade fibers is disclosed. The roll has a generally conical and somewhat concave surface configuration, and the angle of inclination of the roll axis is adjustable with respect to the yarn path leading into contact with the roll. To insure optimal twisting conditions at all adjustable inclinations of the roll, the position of the pivotal axis of the roll, and the shape of the surface of the roll are adapted to each other so that the yarn path leading into contact with the roll is predetermined and remains constant. This in turn assures that the upstream twisting conditions of the yarn are unchanged.

8 Claims, 3 Drawing Sheets

FALSE TWIST ROLL

Background of the Invention

The present invention relates to a false twisting roll of the type used in a false twist crimping machine to impart false twist to a manmade, continuously advancing endless yarn. A false twisting roll of this general type is disclosed in German OS 24 60 031.

The false twisting roll as disclosed in German OS 24 60 031 is arranged so that the angle of lead of the yarn (epsilon) at the beginning of the line of contact with the false twist roll is approximately equal to half the acute angle of the cone of contact (gamma Epsilon) at the point of entry. In order to meet this condition, yarn guides precede the false twist roll. Optimal twist imparting conditions are preset by these yarn guides thus associated to the roll. A change of the twist level while maintaining the optimal twist imparting conditions is not possible It is the object of the present invention to design and construct a false twisting roll, which permits the desired twist level to be adjusted, while maintaining the optimal twist imparting conditions.

Summary of the Invention

The above and other objects and advantages of the present invention are achieved in the embodiments illustrated herein by the provision of a false twisting roll which has a concave yarn contacting surface portion, and which defines a central roll axis. The twisting roll is mounted for rotation about the roll axis and for pivotal movement about a pivot axis which is perpendicular to the roll axis, and the roll may be set in a selected pivotal position. Yarn guide means is provided for guiding an advancing yarn along a predetermined yarn path leading into contact with the yarn contacting surface portion, and the concave yarn contacting surface portion is configured, and the pivotal axis is located, so that in all pivotal positions of the roll the angle alpha is equal to the angle gamma, with the angle alpha being defined as the angle between the predetermined yarn path and a circumferential tangent to the roll at the point of contact of the yarn path to the roll, and with the angle gamma being defined as the angle between the roll axis and a tangent to the concave surface portion at the point of contact of the yarn path to the surface portion and which intersects the roll axis.

The present invention is based upon the discovery that the angle condition, according to which the angle of lead of the yarn at the beginning of the line of contact with the body of rotation, i.e. the angle alpha as defined above, is approximately equal to the half the acute angle of the contact cone at the point of entry, i.e. the angle gamma, is not the cause for an optimal operation of the false twist roll, but is a consequence occurring independently in the operation of the false twist roll. Resulting therefrom is the further discovery that the aforesaid angle condition is maintained when changing the inclination of the roll, but that the looping conditions change on the preceding yarn guide. This disadvantage of the known false twist roll is eliminated by the present invention.

More particularly, in the present invention, the position of the pivotal axis is adapted to the contour of the roll, so that in the predetermined path of the yarn the angle alpha between the contacting yarn and the circumferential tangent of the roll in the point of first contact is always equal to the angle gamma between the roll axis and the tangent of the contour line at the point of first yarn contact, irrespective of the inclination of the roll axis. To this end, the position of the pivotal axis is determined by geometric construction, calculation and/or test, with the contour and yarn path being given. Conversely, with the yarn path and axis of rotation being given, the contour is determined by geometric construction, calculation and/or test. Thereafter, the ideal surface line (contour line) extending in an axial plane of the roll can be approximated by a circular, parabolic, hyperbolic or any mathematically determinable function.

In order to make the yarn path independent of the inclination of the roll, it is further suggested that the end of the roll, from which the yarn leaves, is cylindrically shaped or increases again slightly in diameter. As a result, the point of delivery remains constant.

In accordance with the invention, a false twisting roll is created, which imparts a twist which is exclusively dependent on the inclination of the roll. The invention make it possible to provide the false twisting rolls for a plurality of yarns on a common, pivotable mounting support, so that a common adjustment is made possible, without having a different twist insertion in the individual yarns. Contributory to this end is also a common drive of the rolls.

In a second embodiment of the invention, the twisting roll is mounted for both axial displacement along its central axis and for pivotal movement about a pivot axis which is perpendicular to the axis of the roll. This results in the advantage that, irrespective of the selection of the roll contour, the pivotal axis can be placed at a location favorable from the viewpoint of machine engineering. The axial displacement of the roll thus assures that the desired condition for the first contact, i.e. the angle of inclination of the roll is equal to the angle of the contour cone, is produced without resulting in a change of the looping conditions on the yarn guide preceding the roll—be it a cooling plate or a special yarn guide. Although DE-OS 24 60 031 provides likewise for an axial displacement of the false twist roll, which is intended to bring about a change in the twist level, the latter being based on the change of the looping conditions on the preceding yarn guide, the present invention, however, avoids such a change of the looping conditions by the combination of pivoting and axial displacement.

As can be seen, for the purpose of optimizing the twist insertion, the contour cannot only be adapted to the arbitrarily given position of the pivotal axis. Rather, the profiling of the contour also calls for consideration of the adhesive and sliding properties of the yarn necessary for an optimal twist insertion. Thus, the contour on the thicker receiving end should not be so steep that the contacting yarn slides downwardly without any adhesion, solely as a result of its tension. Consequently, in the zone of the first contact, the angle of the contour cone preferably should be smaller than the angle of static friction of the yarn relative to the false twist roll, and greater than the angle of sliding friction of the yarn. On the other hand, in the delivery zone, the angle of the contour cone should become smaller than the angle of sliding friction, it being provided by the invention, as aforesaid, that the end zone of the roll is cylindrical. Likewise, the smallest and the largest diameter should be determined by test so that an optimal twist insertion occurs. The selection of the position of the pivotal axis is to be subordinated to these requirements.

Brief Description of the Drawings

Some of the objects and advantages of the present invention having been stated, others will appear as the description proceeds, when taken in conjunction with the accompanying drawings, in which.

Detailed Description of the Preferred Embodiments

Figure 1:
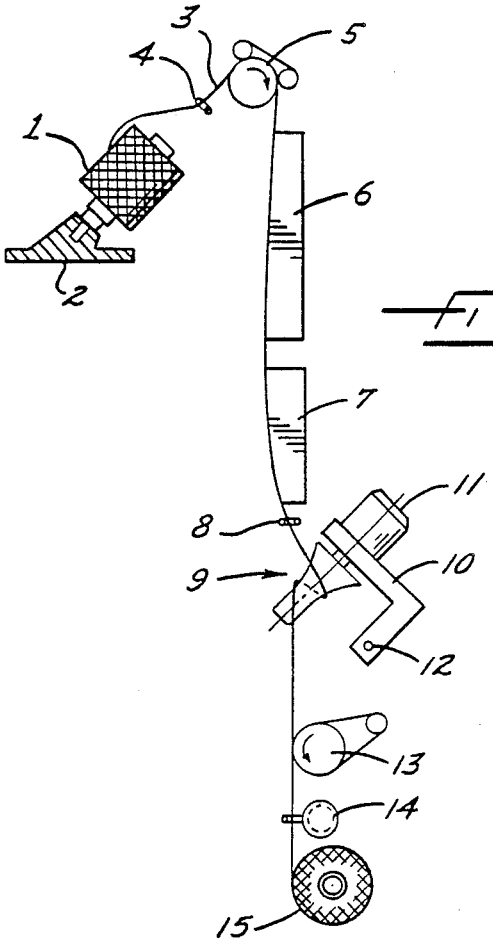
FIG. 1 is a schematic cross sectional view of a false twist crimping machine which embodies the present invention.

In the false twist crimping machine as shown in FIG. 1, a yarn 3 advances from a supply package 1. The supply package 1 is creeled on a holder. The yarn is drawn off overhead, via a yarn guide 4, by means of a feed system 5. The yarn is then guided over a hot plate 6 and subsequently over a cooling plate 7. The extension of the cooling plate 7 determines the path of the yarn contacting a false twisting roll 9. A yarn guide 8 preceding the false twisting roll serves only to ensure the yarn path. There occurs no deflection on the guide 8, so that the twist, which is produced by the false twisting roll, does not accumulate on the yarn guide 8. It is possible, though, to provide for a certain deflection also on the yarn guide. However, according to the invention, this deflection remains constant, so that the twist accumulation and thus also the twist conditions of the yarn do not change on the heater 6 and the cooling plate 7. The yarn loops about the false twisting roll 9 in a predetermined direction. Likewise this direction of looping determines the direction of the twist at the same time, the appearance of the yarn on the roll corresponding to an S or Z twist pattern. The yarn is withdrawn from the false twisting roll 9 by a second feed system 13, reciprocated by a traversing system 14, and wound onto a package 15 of a takeup system.

The false twisting roll 9 is supported on a mounting support 10. The mounting support 10 is pivotable about an axis 12. A motor 11 drives the false twisting roll 9 at a constant speed, which is adapted to the yarn speed.

Figure 2:
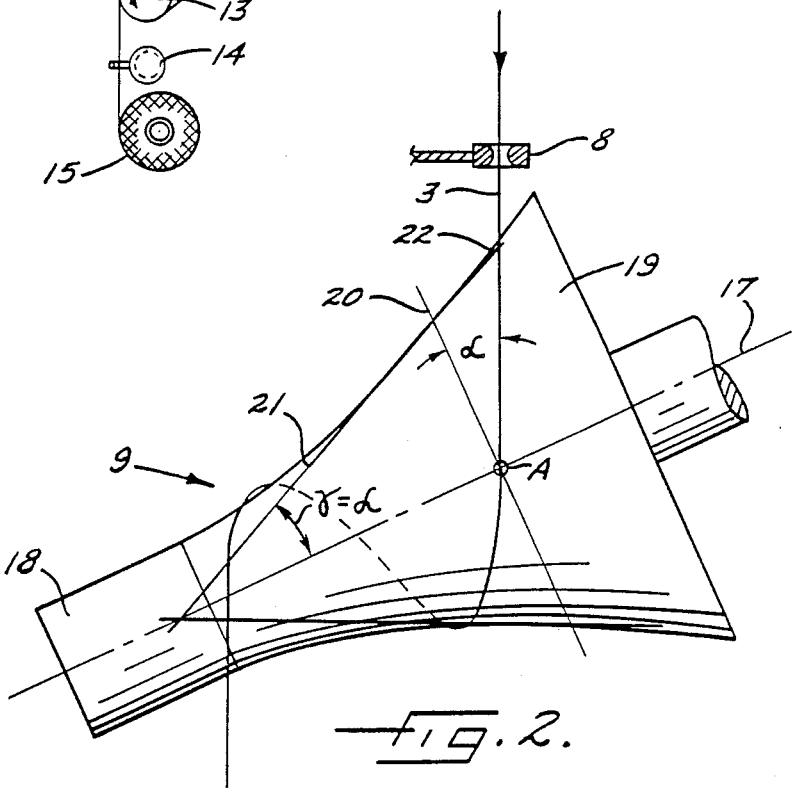
FIG. 2 is a fragmentary view of the false twisting roll shown in FIG. 1.

FIG. 2 illustrates a view of the roll 9 with the yarn 3. It is assumed that the yarn 3 advances in a plane which is parallel to the plane of the paper. The yarn contacts the roll at the point A. Line 20 indicates the circumferential tangent of the roll to point A in the normal plane to the roll extending through the point A (and simultaneously the projection of this normal plane to the plane of the paper). The yarn path 3 forms with the tangent 20 an angle alpha. This angle alpha is equal to the angle of inclination of the roll axis 17 to a plane perpendicularly intersecting the yarn path, and thus represents the inclination of the roll axis 17 relative to the yarn path. Line 21 represents the contour tangent, which is the tangent to the contour line 22 of the roll extending in the plane of the paper. The roll is shaped by the rotation of the contour line 22 about the roll axis 17. The contour line is convex relative to the roll axis 17 and can technically be represented, for example, as a segment of a circle, hyperbola, parabola, or any similar, mathematically determinable curve. The contour tangent 21 forms with the roll axis 7 an angle gamma, which is described within the scope of the present application as the angle of the contour cone.

At the yarn delivery end, the contour line 22 terminates as smoothly as possible in a straight line parallel to the roll axis 17. In other words, the delivery end 18 of the roll is cylindrically shaped.

The path of the yarn 3 advancing onto the false twisting roll 9 always adjusts itself, so that the angle of inclination alpha of the roll is equal to the angle of the contour cone gamma of the point of first contact A.

Figure 3:
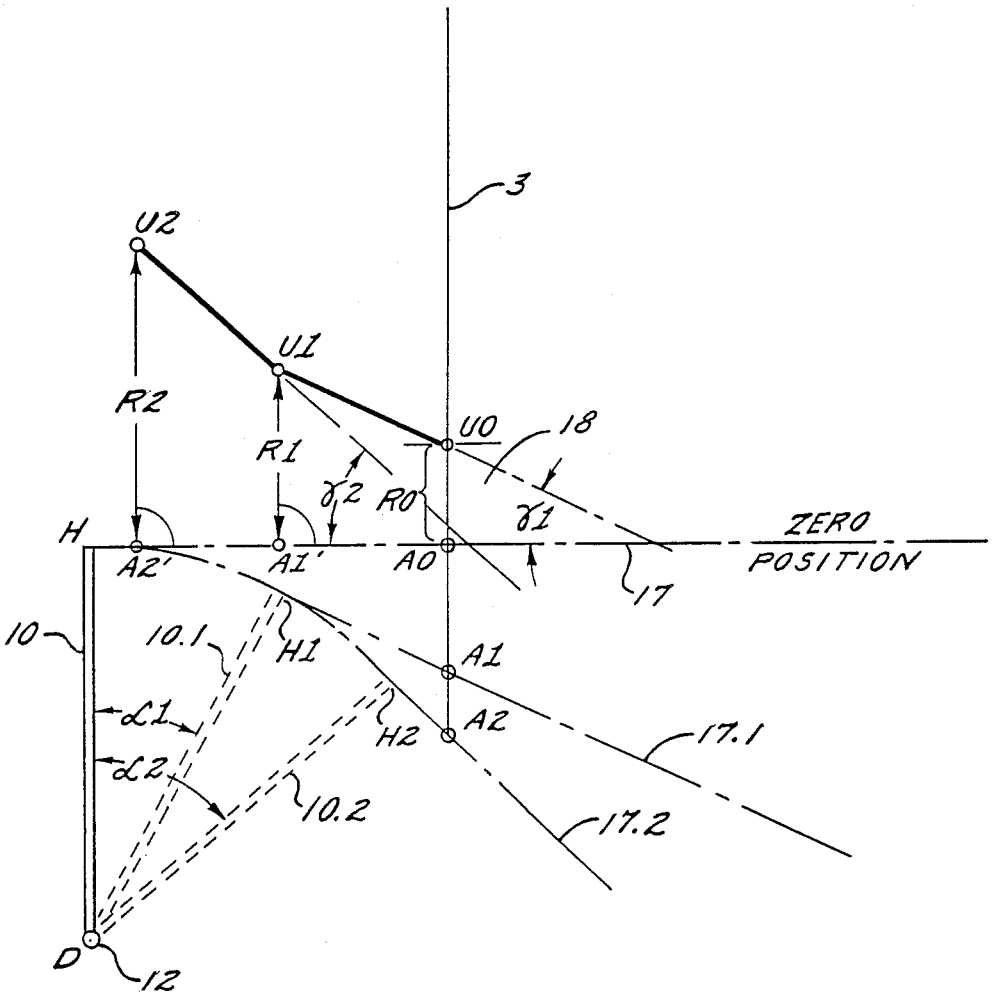
FIG. 3 is a schematic representation of the geometric construction of the contour of the false twisting roll.

FIG. 3 schematically illustrates the geometric construction of the contour line with a given pivot 12, which is here indicated at D. The mounting support of the false twisting roll is indicated by the numeral 10. The zero position of the mounting support is plotted by a solid double line. The zero position of the axis 17 of the false twisting roll is shown in a dash-dotted line and fully spelled out. The path of the yarn 3 is shown by a solid line. In the construction of the contour line, both the position of the pivot D and the yarn path 3 are given. This results in the zero position of the axis and the desired point of first contact AO, which, according to the invention, should lie on the cylindrical delivery end 18 of the false twist roll. In the zero position of the false twist roll, no twist is imparted. A radius RO may be determined for the cylindrical delivery end, so that optimal diameters develop on the false twist roll for the twist insertion. As a result, the first point UO of the contour line is predetermined.

Only two additional points will be constructed hereinbelow, in that the mounting support 10 is pivoted by an angle alpha and by an angle $alpha_2$. As can be seen, a very accurate construction of the contour line is possible when the angles $alpha_1$ and $alpha_2$ differ only little.

When the mounting support 10 is pivoted by the angle alpha, it assumes the position 10.1 indicated by a dashed double line. As a result of this pivoting, the axis of the false twisting roll is at the position 17.1. According to the invention, the yarn path 3 should not change as a result of the inclination of the roll. At an inclination by the angle $alpha_1$ the point of first contact of the yarn on the roll is thus in point A1, which when projected on the plane of the paper is the intersection of the yarn path 3 with the axis 17.1. According to the invention, the tangents to the contour line form now in the yarn contact point A1 with the axis 17.1 an angle of the contour cone $gamma_1$, which is equal to the angle of inclination of the roll and thus equal to the pivotal angle $alpha_1$. Consequently, a line is drawn through the first contour point UO of the contour line, which has the inclination $gamma_1$ relative to the zero position of the axis. At the same time, a straight line between H1 and A1, which represents the axial position of the point of first contact A1, is plotted on the zero position of the axis starting from point H. This results in the point A1' on the zero position of the axis. From the point A1' a perpendicular line is extended. The intersection of this perpendicular line with the line which has the inclination $gamma_1$ relative to the axis, forms the further contour point U1.

The mounting support 10 is now pivoted by the angle $alpha_2$. As a result, the mounting support assumes the position of the dashed double line 10.2, and the roll axis has the position 17.2. The intersection or the roll axis 17.2 with the yarn path 3 results in the yarn contact point A2. Now the straight line H2-A2 is plotted on the zero position of the axis starting from point H. This results in point A2'. Further, a line is drawn through the second contour point U1, which has an inclination $gamma_2$ (which equals $alpha_2$) relative to the zero position of the axis. Another contour point U2 is located in the point where the perpendicular line extended from the point A2' on the zero position of the axis 17 intersects this line.

The perpendicular lines on the zero position of the axis in the respective points A1' and A2' represent each the radii R1 and R2 of the roll in the normal plane, the projection of which is represented by the respective perpendicular lines.

If only two pivotal angles are given, the false twist roll will obtain a discontinuous contour line. However, a steady contour line may be obtained if the pivotal angles are closely stepped.

Figure 4:
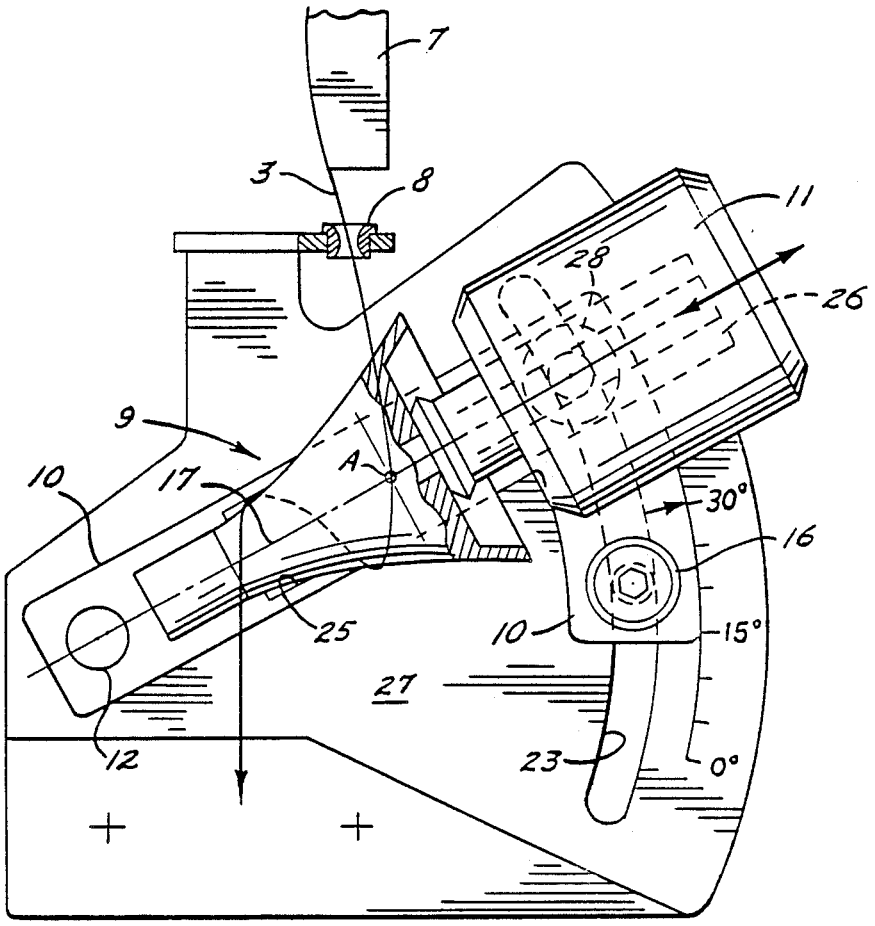
FIG. 4 illustrates a second embodiment of a false twist roll in accordance with the present invention.

FIGS. 4 discloses a second embodiment of the invention. In this embodiment, the roll is supported in a mounting support 10 rotatable about a pivot 12. The roll is driven by a motor 11. The pivoted position of the roll can be secured by a locking mechanism 16 in a slot 23, which is concentric to the pivotal axis and provided in base plate 27. A yarn advances from cooling plate 7 and travels without deflection over yarn guide 8 onto false twisting roll 9. At the same time, the false twisting roll is axially displaceable on the mounting support 10 in the roll axis 17. This allows to always adapt the yarn contact point A to the path of the yarn given by line 3 in any pivoted position.

The axial displacement may be done by hand. However, it is also possible to automatically couple the axial displacement with the pivotal motion by means of a transmission gearing.

Figure 4A:
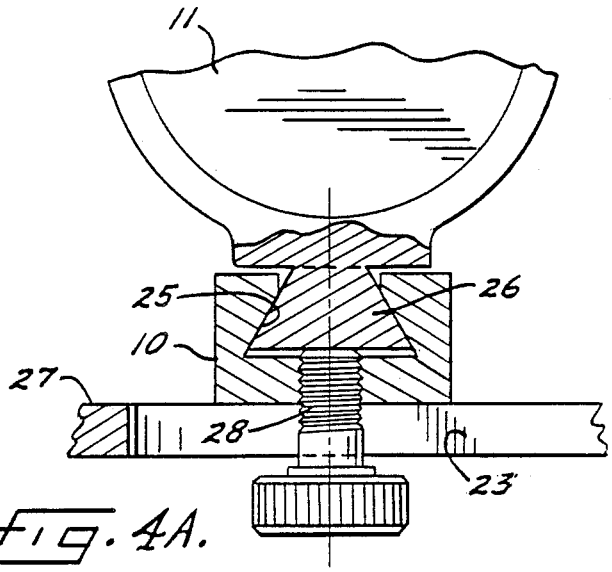
FIG. 4A is a sectional view of one embodiment of the mounting of the drive motor for the false twisting roll.

To this end, the mounting support 10 may be provided with a longitudinal groove 25, which has a dovetailed cross section as shown in FIG. 4A. Aligned in the longitudinal groove is a guide rail 26 having the same cross section. The upper side of the guide rail 26 projects from the groove 25, so that the motor casing 11 with the false twist roll can be mounted thereon. A threaded bore is formed in the underside of the mounting support 10 facing the base plate 27 and in alignment with the slot 23. Inserted into this threaded bore is an adjusting screw 28 which is provided with a knurled head. Upon screwing the adjusting screw 28 into the threaded hole of the mounting support 10, the guide rail can be clamped in the longitudinal groove 25, thereby securing any desired axial position of the false twist roll. The adjusting screw projects from the slot so that a special adjustment is possible in any pivoted position.

In the drawings and specification, there has been set forth a preferred embodiment of the invention, and although specific terms are employed, they are used in a generic and descriptive sense only and not for purposes of limitation.

That which is claimed is:

1. A yarn twisting apparatus for imparting twist to an advancing yarn, and comprising a twisting roll having a concave yarn contacting surface portion, and defining a central roll axis, means mounting said twisting roll for rotation about said roll axis and for pivotal movement about a pivot axis which is perpendicular to said roll axis, and including means for setting said twisting roll in a selected pivotal position, yarn guide means for guiding an advancing yarn along a predetermined yarn path leading into contact with said yarn contacting surface portion, said concave yarn contacting surface portion being configured and said pivotal axis being located so that in all pivotal positions of said roll the angle alpha is equal to the angle gamma, with the angle alpha being defined as the angle between said predetermined yarn path and a circumferential tangent to the roll at the point of contact of the yarn path to the roll, and with the angle gamma being defined as the angle between the roll axis and a tangent to the concave surface portion at the point of contact of the yarn path to said surface portion and which intersects the roll axis.

2. The yarn twisting apparatus as defined in claim 1 wherein said pivot axis is laterally spaced from said roll axis.

3. The yarn twisting apparatus as defined in claim 1 further comprising drive motor means for rotating said twisting roll about said roll axis.

4. The yarn twisting apparatus as defined in claim 1 wherein said twisting roll includes a cylindrical end portion which smoothly merges into said concave yarn contacting surface position.

5. A yarn twisting apparatus for imparting twist to an advancing yarn, and comprising a twisting roll having a concave yarn contacting surface portion, and defining a central roll axis, means mounting said twisting roll for rotation about said roll axis, for axial displacement along said central axis, and for pivotal movement about a pivot axis which is perpendicular to said central roll axis, and including means for setting said twisting roll in a selected pivotal position and in a selected axial position, yarn guide means for guiding an advancing yarn along a predetermined yarn path leading into contact with said yarn contacting surface portion, and so as to define an angle alpha between the yarn path and a circumferential tangent to the roll at the point of yarn contact, and an angle gamma between the roll axis and a tangent to the concave surface portion at the point of yarn contact and which intersects the roll axis, said concave yarn contacting surface portion being configured and said pivotal axis being located such that upon pivotal movement of said roll about said pivotal axis, the roll may be axially displaced along said roll axis so as to permit the yarn path of travel to be maintained unchanged, and the angle alpha maintained equal to the angle gamma.

6. The yarn twisting apparatus as defined in claim 5 wherein said pivot axis intersects said central roll axis.

7. The yarn twisting apparatus as defined in claim 5 further comprising drive motor means for rotating said twisting roll about said roll axis.

8. The yarn twisting apparatus as defined in claim 5 wherein said twisting roll includes a cylindrical end portion which smoothly merges into said concave yarn contacting surface position.

* * * * *